United States Patent [19]

Weissman

[11] 4,221,082

[45] Sep. 9, 1980

[54] DEVICE FOR HOLDING PRECIOUS STONES DURING CUTTING AND POLISHING THE FACETS THEREOF

[75] Inventor: Ilan Weissman, Herzelia, Israel

[73] Assignee: Hargem Ltd., Ramat Gan, Israel

[21] Appl. No.: 7,478

[22] Filed: Jan. 26, 1979

[51] Int. Cl.[3] ..... B24B 9/16

[52] U.S. Cl. ..... 51/229; 125/11 N

[58] Field of Search ..... 51/229, 121, 125; 125/11 N, 30 R

[56] References Cited

U.S. PATENT DOCUMENTS

| | | | |
|---|---|---|---|
| 893,920 | 7/1908 | Griesch | 51/229 |
| 2,542,698 | 2/1951 | O'Brien | 51/229 |
| 2,999,493 | 9/1961 | Blair | 125/11 N |
| 3,098,327 | 7/1963 | Malin | 51/229 X |
| 3,135,073 | 6/1964 | Odle | 51/229 |
| 4,140,098 | 2/1979 | Sawin | 125/11 N |

FOREIGN PATENT DOCUMENTS

| | | | |
|---|---|---|---|
| 997955 | of 1951 | France | 51/229 |

*Primary Examiner*—Harold D. Whitehead

*Attorney, Agent, or Firm*—Benjamin J. Barish

[57] ABSTRACT

A device for holding precious stones during cutting and polishing the facets thereof comprises a rod having a mounting tip at one end for mounting the stone, a positioning collar loosely received on the rod so as to be movable both axially and rotatably thereon and including a plurality of flat faces on its outer surface each adapted to be pressed against a locating surface of an aligning fixture for positioning the stone with respect to a cutting or polishing disc, an indexing collar having a plurality of indexing positions, and spring means for fixing the positioning collar to the indexing collar and the latter collar to the rod at desired preselected positions.

8 Claims, 3 Drawing Figures

DEVICE FOR HOLDING PRECIOUS STONES DURING CUTTING AND POLISHING THE FACETS THEREOF

BACKGROUND OF THE INVENTION

The present invention relates to a device for holding precious stones during cutting and polishing the facets thereof.

Precious stones are usually mounted to a holder, sometimes called a "Dop", during the cutting and polishing of their facets, the holder being held by hand while the stone is pressed against a rotatary-driven cutting or polishing disc. One common form of hand-held holder includes a rod having a mounting tip at one end of mounting the stone to be polished, and a positioning collar fixed to the rod adjacent to the mounting tip, the positioning collar having an outer polygonal (e.g. octagonal) configuration for positioning the stone in different angular positions with respect to the cutting or polishing disc. Such an arrangement, however, enables only a limited number of facets to be conveniently cut and polished because of the limited number of flat surfaces provided by the polygonal configuration of the positioning collar.

Another device commonly used includes a holding fixture which receives the rod to which the stone is mounted, the holding fixture including a clamping arrangement for receiving and securely clamping the rod thereto. Such holding fixture, however, is of a relatively complicated and costly construction and therefore one such fixture is usually used with a series of rods. The usual procedure is to apply a series of rods, one after the other, to the fixture for first cutting the facets in the stones carried by the series of rods, and then to reintroduce the rods again one after the other for polishing the cut facets. This produces an alignment problem in aligning the rod, when inserted for the subsequent polishing operation, exactly in the same position it was in the fixture during the facet cutting operation.

An object of the present invention is to provide a device for holding precious stones during the cutting and polishing of thier facets which device has advantages in both of the above respects.

More particularly, an object of the present invention is to provide a device for holding a precious stone to enable a large number of different facets to be cut and polished, which device is of simple and inexpensive construction such as to permit it to be retained attached to the stone during both the cutting and the polishing operation thereby obivating the alignment problems mentioned above.

SUMMARY OF THE INVENTION

According to a broad aspect of the present invention, there is provided a device for holding precious stones during cutting and polishing the facets thereof, comprising: a rod having a mounting tip at one end for mounting the stone, and a coincal outer surface located adjacent to said mounting tip and tapered inwardly towards the opposite tip of the rod; a positioning collar loosely received on the rod so as to be movable both axially and rotatably thereon, and including a flat outer surface adapted to be pressed against a locating surface of an aligning fixture for positioning the stone, when mounted on the rod, with respect to a cutting or polishing disc; and indexing collar including a plurality of indexing positions received on the rod between its conical surface and said positioning collar; a spring urging the positioning collar towards the indexing collar, and the indexing collar against said conical surface of the rod for non-rotatably fixing the indexing collar on the rod; and interlocking elements carried by said two collars and effective; when the positioning collar is urged towards the indexing collar, to lock the two collars at a preselected angular indexing position with respect to each other, and thereby to position the rod, and the stone when mounted thereon, in a preselected angular position with respect to said flat outer surface of the positioning collar.

According to further features in the preferred embodiment of the invention described below, the spring is a coil spring and is interposed between a ring fixed to the rod and a shoulder form on the positioning collar; also the ring is fixed to the rod by being press-fitted over said outer conical surface thereof.

According to a further feature included in the described preferred embodiment, the interlocking elements comprise a projection carried by one collar selectively receivable in one of a plurality of recesses formed in the other collar. More particularly, the projection is a pin fixed to the positioning collar, and the plurality of recesses are notches formed around the periphery of the indexing collar.

In the preferred embodiment of the invention described below, the positioning collar includes an outer polygonal surface defining a plurality of said flat surfaces for positioning the stone at a plurality of angular positions, said indexing positions on the indexing collar being located to enable positioning the rod at anyone of a plurality of flat surfaces on the positioning collar. More particularly, the outer surface of the positioning collar is octagonal, providing eight flat surfaces, and said indexing collar includes eight intermediate indexing positions for each of said eight flat surfaces.

Further features and advantages of the invention will be apparent from the description below.

BRIEF DESCRIPTION OF THE DRAWINGS

The invention as herein described, by way of example only, with reference to the accompanying drawings, wherein.

DESCRIPTION OF THE PREFERRED EMBODIMENT

Figure 1:
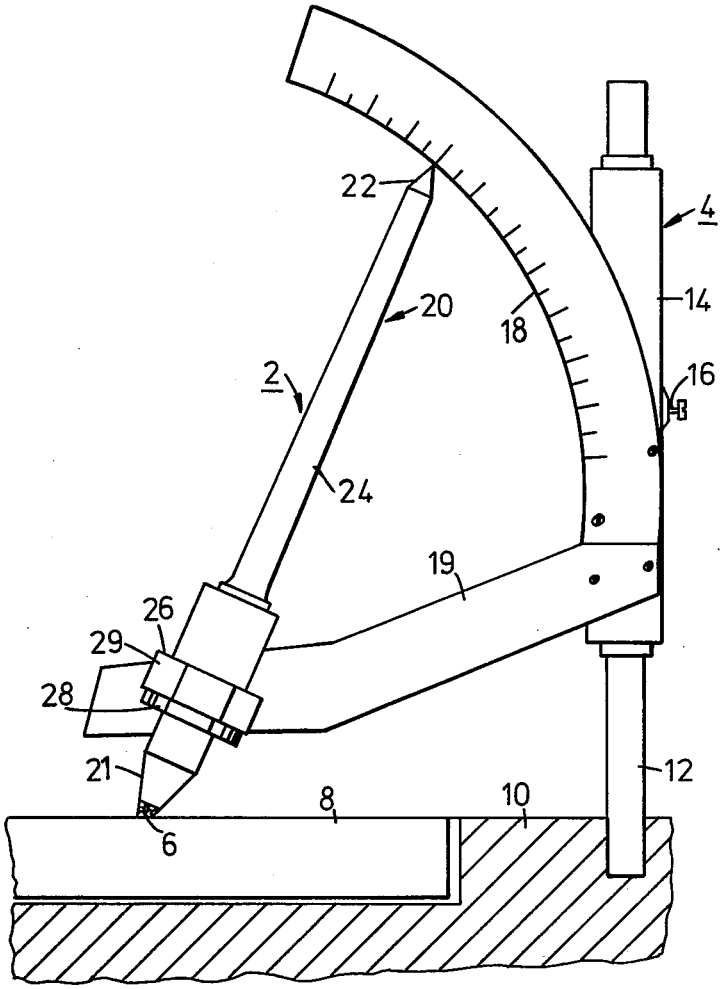
FIG. 1 is a side elevational view illustrating one form of holder constructed in accordance with the invention, together with an aligning fixture with which the holder is used for cutting the polishing the facets of precious stones.

In FIG. 1, the holder constructed in accordance with the invention for use in cutting and polishing the facets of precious stones, is generally designated 2. It is to be used with a fixture, generally designated 4, for pressing the stone 6 against a cutting or polishing disc 8 rotatable with respect to a base 10. Fixture 4, sometimes called a quadrant, includes a vertical post 12 fixed to base 10, which post supports a sleeve 14 presettable to a desired vertical position by means of a threaded fastener 16. Sleeve 14 carries a graduated scale 18 and an arm 19 providing a flat vertical surface cooperable, in the manner to be described below, with positioning surfaces carried by the holder 2 for positioning the stone 6 in preselected angular positions with respect to the cutting or polishing disc 8.

The holder 2 comprises a rod 20 tapered at one end 21 for mounting the stone 6, and pointed at the opposite end 22 for cooperation with the graduated scale 18. Rod 20 is provided with a conical outer surface 23 (FIG. 2) for about one-quarter its length adjacent to its end 21, this surface being tapered inwardly in the direction towards its opposite tip 22. The remainder of the length 24 of the rod, between conical portion 23 and tip 22, is of substantially uniform diameter.

Holder 2 further includes two collars 26 and 28 received on the conical portion 23. Collar 26 is a positioning collar cooperable with positioning arm 19 of fixture 4, and includes a plurality of flat surfaces 29 for positioning stone 6 with respect to disc 8. Collar 26 is loosely received over conical portion 23 of the rod 20 so as to be movable axially and rotatably thereon. Collar 28 is an indexing collar which, in use, is non-rotatably fixed to rod 20. It includes a plurality of angular indexing positions cooperable with collar 26 for selectively positioning rod 20, and the stone 6 carried thereby, in a plurality of intermediate positions for each of the flat positioning surfaces 29 with respect to the cutting and polishing disc 8.

Figure 2:
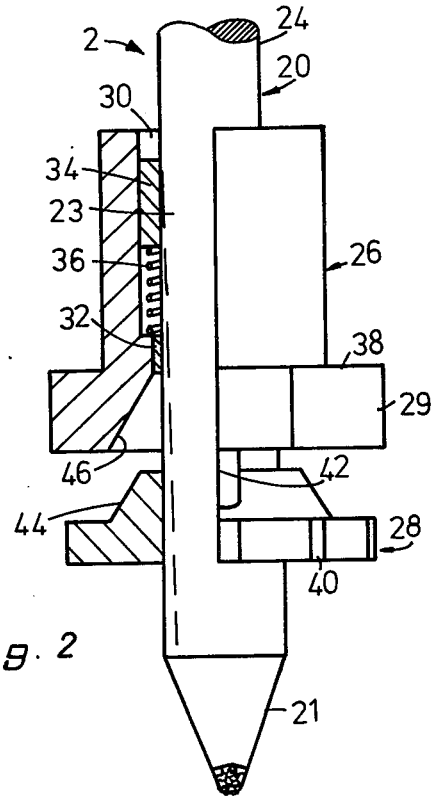
FIG. 2 is a longitudinal section through a portion of the holder of FIG. 1.

As shown particularly in FIG. 2, the positioning collar 26 is formed with a bore 30 of larger diameter than conical portion 23 of rod 2 so as to be loosely received on the rod, the diameter of bore 30 being slightly decreased at one end to provide a shoulder 32. A ring 34 is fixed to rod 20 by being pressfitted to its conical portion 23. A coil spring 36 is interposed between ring 34 and shoulder 32 of collar 26, spring 36 thereby urging collr 26 towards indexing collar 28, which is thereby pressed against conical portion 23 of rod 20 for fixing same to the rod. The flat positioning surfaces 29 on collar 26 are formed on an enlarged-diameter head 38 having a polygonal, in this case octagonal, configuration defining eitht flat positioning surfaces 29.

Figure 3:
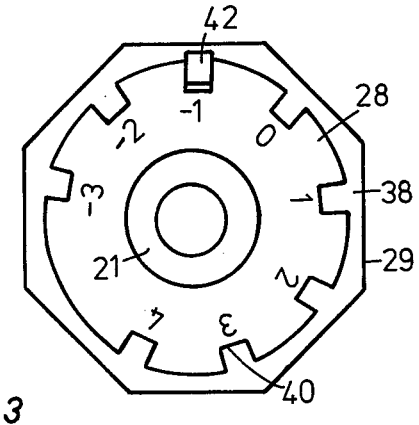
FIG. 3 is an end view of the holder of FIGS. 1 and 2.

Indexing collar 28 is provided with a plurality of recesses in the form of edge notched 40 around its periphery, which notches are cooperable with a projection in the form of a pin 42 carried by collar 26. As shown in FIG. 3, collar 28 is provided with eight indexing notches graduated to define eight intermediate positions (three negative positions, four positive positions, and one "zero" position) for each of the eight flat surfaces 29 on the positioning collar 26. The outer surface 44 of collar 28 at its upper end is tappered and receives a correspondingly tapered seat 46 formed in collar 26, when the latter is urged against collar 28 by spring 36.

The holder illustrated in the drawings may be used in the following manner:

First, a stone 6 to be cut and polished is mounted to the tip 21 of the holder 2 in any suitable manner, such as by the use of a bonding agent. For purposes of example, pin 38 of collar 26 is shown as being seated within the "1" notch 40 of collar 28. The holder is then manually helf with one of the flat surfaces 29 on the positioning collar 26 pressed against arm 19 of the fixture 4 at the desired angular position with respect of the cutting and polishing disc 8, as shown by pointed tip 22 of the rod 20 cooperable with the graduated scale 18. The stone fact is thus cut or polished at the desired angle. The holder 2 is then manually turned, and the next flat surface 29 is pressed against arm 19 to cut or polish the next facet, while the holder is held at the same angular position with respect to scale 18. An annular series of eight facets are thus cut or polished, each while pressing one of the flat surfaces 29 against arm 19.

After the series of eight facets have thus been cut or polished, collar 26 is manually pushed upwardly against spring 36 to withdraw pin 42 from the "1" notch 40 of the indexing collar 28, and collar 26 is angularly rotated on rod 20 to bring pin 42 into alignment with the next notch 40 (e.g. the "2" notch) on the indexing collar, whereupon the collar is released to permit spring 36 to seat pin 42 into that notch. This operation angularly indexes or displaces collar 26 a small amount with respect to collar 28 and the rod 20 to which it is fixed, as well as the stone 6 fixed to the rod. The holder 2 may then be held in a slightly different angular position as shown by scale 18 for cutting or polishing a second series of eitht facets around the stone, each facet being cut or polished while pressing one of the eight flat surfaces 29 against arm 19 on the fixture 4. It will be seen that this second series of facets will be slightly displaced angularly of the stone by the angular distance between the two notches 40 in the indexing collar 28 during the cutting or polishing of the two series of facets.

The holder than may be used for cutting or polishing a third series of eight facets by indexing collar 28 one position in the manner described above, which third series will be displaced the angular distance between the notches 40. In a similar manner, additional series of facets may be formed by displacing collar 26 by one notch with respect to collar 28.

It will thus be seen that the invention provides a holder of simple and inexpensive construction such that its positioning and indexing elements can be retained on the holder for both the cutting operation as well as the polishing operation, thereby obviating alignment problems. In addition, a large number of indexing positions (64 in the described example) are permitted by the device. Further, the indexing collar can be easily set or reset to any desired angular position with respect to the rod by merely unseating it from its conical seal, and rotating the collar.

While the invention has been described with respect to one preferred form of holder, and one procedure for using the holder, it will be appreciated that many variations, modifications and other applications of the invention may be made.

I claim:

1. A device for holding precious stones during cutting and polishing the facets thereof, comprising: a rod having a mounting tip at one end for mounting the stone, and a conical outer surface located adjacent to said mounting tip and tapered inwardly towards the opposite tip of the rod; a positioning collar loosely received on the rod so as to be movable both axially and rotatably thereon, and including a flat outer surface adapted to be pressed against a locating surface of an aligning fixture for positioning the stone, when mounted on the rod, with respect to a cutting or polishing disc; an indexing collar including a plurality of indexing positions received on the rod between its conical surface and said positioning collar; a spring urging the positioning collar towards the indexing collar, and the indexing collar against said conical surface of the rod for non-rotatably fixing the indexing collar on the rod; and interlocking elements carried by said two collars and effective, when the positioning collar is urged towards the indexing collar, to lock the two collars at a preselected angular indexing position with respect to each other, and thereby to position the rod, and the stone when mounted thereon, in a preselected angular position with respect to said flat outer surface of the positioning collar.

2. A device according to claim 1, wherein said spring is a coil spring and is interposed between a ring fixed to the rod and a shoulder formed on the positioning collar.

3. A device according to claim 2, wherein said ring is fixed to the rod by being press-fitted over said outer coincal surface thereof.

4. A device according to claim 1, wherein said interlocking elements comprise a projection carried by one collar selectively receivable in one of a plurality of recesses formed on the other collar.

5. A device according to claim 4, wherein said projection is a pin fixed to a positioning collar, and the plurality of recesses are notches formed around the periphery of the indexing collar.

6. A device according to claim 1, wherein said positioning collar includes an outer polygonal surface defining a plurality of said flat surfaces for positioning the stone at a plurality of angular positions, said indexing positions on the indexing collar being located to enable positioning the rod at anyone of a plurality of intermediate positions for each of the plurality of flat surfaces on the positioning collar.

7. A device according to claim 6, wherein said outer surface of the positioning collar is octagonal, providing eight flat surfaces, and said indexing collar includes eight intermediate indexing positions for each of said eight flat surfaces.

8. A device according to claim 1, wherein the opposite tip of the rod is tapered to a point for cooperation with a graduated scale carried by said aligning fixture.

* * * * *